US007512367B2

(12) United States Patent
Parks

(10) Patent No.: US 7,512,367 B2
(45) Date of Patent: Mar. 31, 2009

(54) ULTRASONIC BACKER FOR BIAS TRANSFER SYSTEMS

(75) Inventor: Bruce J. Parks, Bloomfield, NY (US)

(73) Assignee: Xerox Corporation, Norwalk, CT (US)

( * ) Notice: Subject to any disclaimer, the term of this patent is extended or adjusted under 35 U.S.C. 154(b) by 397 days.

(21) Appl. No.: 11/349,582

(22) Filed: Feb. 8, 2006

(65) Prior Publication Data

US 2007/0183821 A1 Aug. 9, 2007

(51) Int. Cl.
*G03G 15/16* (2006.01)

(52) U.S. Cl. ..... 399/319

(58) Field of Classification Search ..... 399/313, 399/319, 162–164

See application file for complete search history.

(56) References Cited

U.S. PATENT DOCUMENTS

| | | | | |
|---|---|---|---|---|
| 4,823,102 | A | 4/1989 | Cherian et al. | |
| 5,329,341 | A * | 7/1994 | Nowak et al. | 399/319 |
| 5,697,035 | A * | 12/1997 | Mashtare et al. | 399/319 |
| 6,032,004 | A | 2/2000 | Mirabella, Jr. et al. | |
| 6,208,824 | B1 | 3/2001 | Mashtare et al. | |
| 6,422,984 | B1 | 7/2002 | Masham et al. | |
| 2003/0133729 | A1 | 7/2003 | Thomspon et al. | |
| 2004/0114015 | A1 | 6/2004 | Tarnawskyj et al. | |
| 2005/0254863 | A1 | 11/2005 | Kitagawa et al. | |

FOREIGN PATENT DOCUMENTS

| | | | |
|---|---|---|---|
| JP | 01288877 A | * | 11/1989 |
| JP | 10186883 A | * | 7/1998 |

* cited by examiner

*Primary Examiner*—David M Gray
*Assistant Examiner*—Erika Villaluna
(74) *Attorney, Agent, or Firm*—Gibb I.P. Law Firm, LLC

(57) ABSTRACT

Embodiments herein comprise a printing apparatus having a media path and a printing engine along the media path. The printing engine comprises a back up roll having an outer surface and an inner surface, a bias roll adjacent the outer surface of the back up roll, a photoreceptor belt, and a transfer belt. The bias roll is positioned with respect to the back up roll to form a nip between the bias roll and the back up roll. A portion of the photoreceptor belt is in the nip between the bias roll and the back up roll, and a portion of the transfer belt is in the nip between the bias roll and the photoreceptor belt. A transducer (e.g., an ultrasonic piezoelectric device) is contacting the inner surface of the back up roll. The transducer is physically connected to the back up roll in a manner such that the transducer transfers vibrations to the back up roll and to the photoreceptor belt. For example, in one embodiment, the transducer contacts and is physically biased against the inner surface of the back up roll.

20 Claims, 3 Drawing Sheets

ULTRASONIC BACKER FOR BIAS TRANSFER SYSTEMS

BACKGROUND

Embodiments herein generally relate to electrostatic printers and more particularly to an improved apparatus for transferring toner particles utilizing photo receptor belts.

As the speed of printers and copiers continues to increase, various problems are encountered in the printing engine. One problem occurs with incomplete toner transfer to various types of media (paper, transparencies, card stock, etc.) that have physical characteristics such as roughness, thickness, material makeup, etc., to which toner has a difficult time transferring. The various embodiments described below address these and other needs.

SUMMARY

One exemplary embodiment herein comprises a printing apparatus having a media path and a printing engine along the media path. The printing engine comprises a back up roll having an outer surface and an inner surface, a bias roll adjacent the outer surface of the back up roll, a photoreceptor belt, and a transfer belt. The bias roll is positioned with respect to the back up roll to form a nip between the bias roll and the back up roll. A portion of the photoreceptor belt is in the nip between the bias roll and the back up roll, and a portion of the transfer belt is in the nip between the bias roll and the photoreceptor belt. A transducer (e.g., an ultrasonic piezoelectric device) is contacting the inner surface of the back up roll. The transducer is physically connected to the back up roll in a manner such that the transducer transfers vibrations to the back up roll and to the photoreceptor belt. For example, in one embodiment, the transducer contacts and is physically biased against the inner surface of the back up roll.

The vibrations reduce the adhesion forces holding the toner particles on the photoreceptor belt, allowing the toner to transfer more easily to the receiving substrate. In some embodiments, the transducer is connected to the back up roll at a location corresponding to the nip. In other embodiments the back up roll comprises a skid plate.

BRIEF DESCRIPTION OF THE DRAWINGS

Various exemplary embodiments of the systems and methods are described in detail below, with reference to the attached drawing figures, in which.

DETAILED DESCRIPTION

Figure 1:
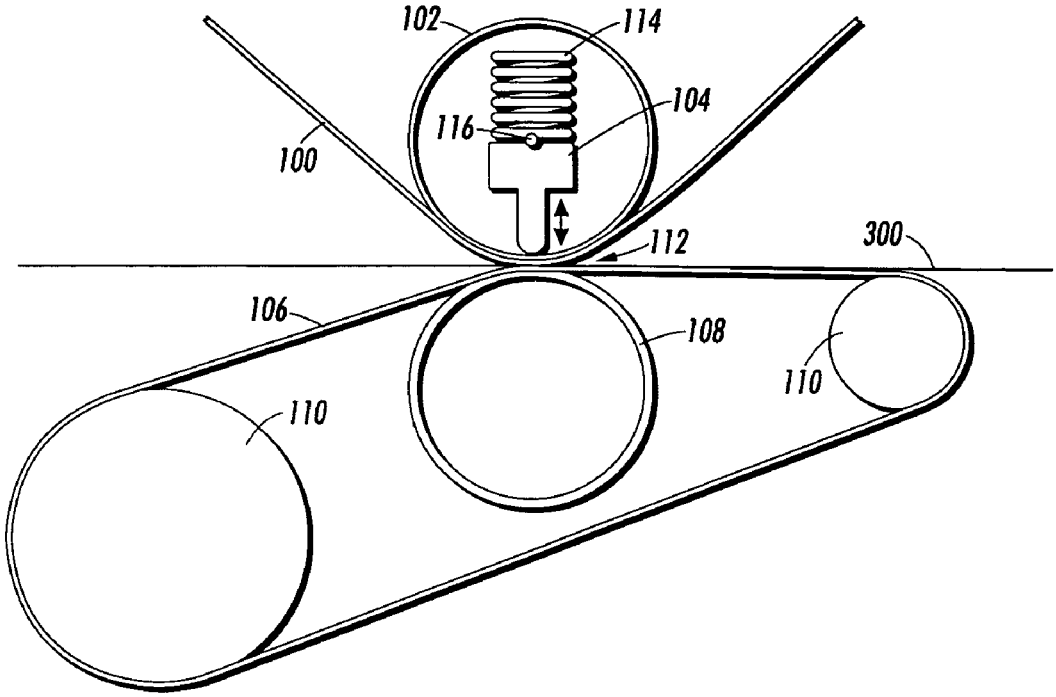
FIG. 1 is a schematic representation of a belt transfer system according to embodiments herein.

As discussed above, one problem that occurs with high speed printers and copiers is incomplete toner transfer to various types of media that have physical characteristics such as roughness, thickness, material makeup, etc., to which toner has a difficult time transferring. Effective toner transfer onto rough stock can be achieved with Acoustic Transfer Assist (ATA) which vibrates the photoreceptor belt within the printer engine. When the photoreceptor belt is vibrated, more toner is transferred to the media because the vibrations reduce the adhesion forces holding the toner particles on the photoreceptor belt. When this action is combined with the electrostatic forces, the toner particles more readily move from the electrostatic elements to the media.

For example, U.S. Pat. No. 6,208,824, the complete disclosure of which is incorporated herein by reference, discloses using a resonating donor member. One feature of using such a resonating donor member is reduced toner adhesion forces in the development zone which allows the use of low DC fields. Another feature of the resonating donor member is it generates a low localized toner cloud. However, such resonating donor members were not conventionally applicable to photoreceptor belt systems.

With embodiments herein an ultrasonic transducer assembly is added to the back-up roll, creating an Ultrasonic Back-up Roll (UBR) to assist toner transfer in photoreceptor belt systems. The transducer vibration transmits through the UBR shell and imparts inertial energy into the toner to reduce adhesion forces to the photoreceptor belt.

U.S. Patent Application 2005/0254863 (the complete disclosure of which is incorporate by reference) describes many of the fundamentals of electrostatic toner transfer to media utilizing photoreceptor belts and transfer belts. More specifically, electrostatic imaging and printing processes are comprised of several distinct stages. These stages may generally be described as charging, imaging, exposing, developing, transferring, fusing, and cleaning. In the charging stage, a uniform electrical charge is deposited on the surface of a photoreceptor so as to electrostatically sensitize the surface. Imaging converts the original image into a projected image exposed upon the sensitized photoreceptor surface. An electrostatic latent image is thus recorded on the photoreceptor surface corresponding to the original image. Development of the electrostatic latent image occurs when charged toner particles are brought into contact with this electrostatic latent image. The charged toner particles will be attracted to the charged regions of the photoreceptor surface that correspond to the electrostatic latent image. In the case of a single step transfer process, the photoreceptor surface with the electrostatically attracted toner particles is then brought into contact with an image receiving surface i.e., paper or other similar substrate. The toner particles are imparted to the image receiving surface by a transferring process wherein an electrostatic field attracts the toner particles towards the image receiving surface causing the toner particles to adhere to the image receiving surface rather than to the photoreceptor. The toner particles then fuse into the image receiving surface by a process of melting and/or pressing. The process is completed when the remaining toner particles are removed from the photoreceptor surface by a cleaning apparatus.

Transferring the toner particles from the photoreceptor surface to the image receiving surface of the substrate is usually performed by applying an electrostatic force field in the transfer nip region sufficient enough to overcome the adhesion force between the toner particles and the photoreceptor surface. If the applied force field is sufficient, the toner particles will move from the photoreceptor surface to the image receiving surface.

The nip region comprises the point at which the photoreceptor and the image receiving surface come into direct contact. Typically most of the toner particles are transferred to the image receiving surface within the contact nip and at the end of the contact nip, just as the surfaces start to separate. The pre-nip region comprises the region upstream from the nip region. In the pre-nip region, there is an air gap between the photoreceptor and the image receiving surface since the two have not yet come into direct contact. The toner particles are attached to the photoreceptor by adhesion forces, and have not yet come into contact with the image receiving surface. The term "adhesion forces" includes both electrostatic adhesion (e.g., the image force) and non-electrostatic adhesion (e.g., van der Waals forces and capillary forces). The post-nip region is downstream from the nip region. There is also an air gap between the photoreceptor and the image receiving surface in the post-nip region. In this region, the majority of the toner particles typically have been transferred to the image receiving surface and will soon be fused to the image receiving surface.

Figure 4:
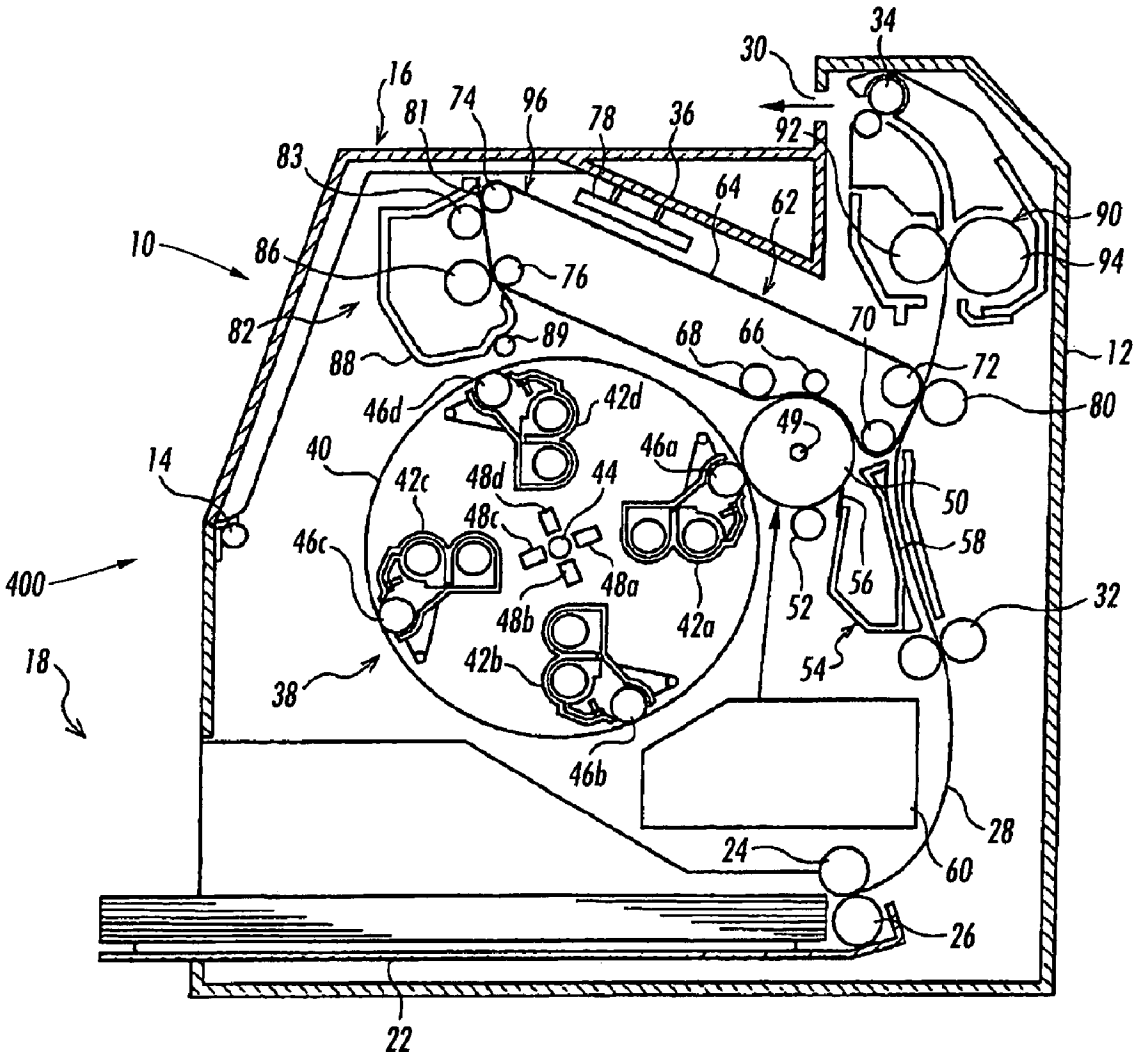
FIG. 4 is a schematic representation of a printing device using a belt transfer system according to embodiments herein.

All apparatus embodiments herein can comprise, as shown in FIG. 4 for example, a printing apparatus 300 an intermediate transfer device 62 and a color printer 10 in which this intermediate transfer device 62 is attached to a color printer main body 12. The color printer 10 includes the color printer main body 12. A rotatable opening and closing cover 16 is provided around a rotation fulcrum 14 in an upper portion of the color printer main body 12. A feeder unit 18 is provided in a lower portion of the color printer main body 12.

The feeder unit 18 includes a paper feed cassette 22 which accommodates recording papers P. A feed roll 24 and a retard roll 26 are provided at an upper and inner-most area of the cassette 22. A feed roll 24 rotates to feed a paper P from the cassette 22 and a retard roll 26 handles the supplied recording papers P one by one.

A conveyance path 28 is a path of the recording paper P from the feed roll 24 to a discharge port 30. Note that item 28 can represent a media transport belt or a media transport path. The conveyance path 28 is formed substantially vertically between the feeder unit 18 and a fuser 90 near a rear side (right side in FIG. 4) of the color printer main body 12. A secondary transfer roll 80 and a secondary transfer backup roll 72 are arranged on the conveyance path 28 upstream of the fuser 90. Resist rolls 32 are arranged upstream of the secondary transfer roll 80 and the secondary transfer backup roll 72. Discharge rolls 34 are arranged on the conveyance path 28 near the discharge port 30.

Therefore, the recording papers P fed out from the paper feed cassette 22 of the feeder unit 18 by the feed roll 24 are handled by the retard roll 26. Only the uppermost recording paper P is introduced to the conveyance path 28, temporarily stopped by the resist rolls 32. Then the uppermost paper P is conveyed to pass between the secondary transfer roll 80 and the intermediate transfer belt 64 (the secondary transfer backup roll 72) at an appropriate timing, thereby transferring toner images onto the uppermost recording paper P. The transferred toner images are fixed onto the paper P by the fuser 90. The resultant paper P is discharged from the discharge port 30 to a discharge section 36 provided on an upper portion of the opening and closing cover 16 by the discharge rolls 34. This discharge section 36 is inclined such that a discharge port is low and other parts are gradually higher toward a frontal direction (left direction in FIG. 4).

A rotary development device 38 is arranged substantially in a central part of the color printer main body 12. The rotary development device 38 includes developing units 42*a* to 42*d* that form toner images of four colors of yellow, magenta, cyan, and black, respectively, within a development device main body 40. The rotary development device 38 rotates leftward or counterclockwise in FIG. 4 around a rotary development device center 44. The development units 42*a* to 42*d* include development rolls 46*a* to 46*d*, and are pressed in a normal direction of the development device main body 40 by elastic bodies 48*a* to 48*d* such as coil springs, respectively.

A photosensitive drum 50 that rotates around a rotation spindle 49 is arranged to be in contact with the rotary development device 38. While the rotary development device 38 is not in contact with the photosensitive drum 50, an outer periphery of each of the development rolls 46*a* to 46*d* partially protrudes by about two millimeters from an outer periphery of the development device main body 40 in a radial direction. Tracking rolls (not shown) with a diameter slightly larger than the diameters of the development rolls 46*a* to 46*d* are provided at both ends of the respective development rolls 46*a* to 46*d* so as to rotate coaxially with the development rolls 46*a* to 46*d*. Namely, the development units 42*a* to 42*d* are arranged around the rotary development device main body 44 on the outer periphery of the development device main body 40 at intervals of 90 degrees. While the tracking rolls on the development rolls 46*a* to 46*d* are in contact with flanges (not shown) at both ends of the photosensitive drum 50 and predetermined gaps are formed between the development rolls 46*a* to 46*d* and the drum 50, respectively, the development units 42*a* to 42*d* develop a latent image on the drum 50 by the respective color toners.

A charge roll 52 is provided below the photosensitive drum 50. By applying a charging bias to the charge roll 52, the photosensitive drum 50 is uniformly charged. A photosensitive drum cleaner 54 is hung from the rotation spindle 49 of the photosensitive drum 50. The photosensitive drum 50 and the photosensitive drum cleaner 54 are formed to be integrated with each other. The photosensitive drum cleaner 54 has a cleaning blade 56 which scrapes off waster toners remaining on the photosensitive drum 50 after a primary transfer, and a toner recovery case 58 which recovers the waste toners scratched up by the cleaning blade 56.

A rib or the like is formed on a rear surface (a right side in FIG. 4) of the toner recovery case 58. The rear surface of the toner recovery case 58 is curved so as to smoothly convey the recording paper P and forms a part of the conveyance path 28. An exposure device 60 that writes the latent image on the photosensitive drum 50 charged by the charge roll 52 by a beam such as a laser beam is arranged on a lower rear surface side of the rotary development device 38. An intermediate transfer device 62 is provided above the rotary development device 38. The intermediate transfer device 62 subjects the toner images visualized by the rotary development device 38 to the primary transfer by at a primary transfer position and conveys the resultant toner image to a secondary transfer position. The secondary transfer position is a nip part between the secondary transfer roll 80 and the secondary backup roll 72.

The intermediate transfer device 62 is structured to include, for example, the following parts. The intermediate transfer belt 64, a primary transfer roll 66, a wrap-in roll 68, a wrap-out roll 70, the secondary transfer backup roll 72 (which can contain the ultrasonic transducer discussed below), a cleaning backup roll 74, and a brush backup roll 76. The intermediate transfer belt 64 is elastic. The intermediate transfer belt 64 is stretched so as to have a generally rectangular shape having long sides and short sides above the rotary development device 38, and to be substantially flat. The both long sides of the intermediate transfer belt 64 are stretched so as to be substantially in parallel to the discharge section 36 provided in the upper portion of the color printer main body 12. The wrap-in roll 68 is arranged upward of the primary transfer roll 66 on the lower long side of the intermediate transfer belt 64. The intermediate transfer belt 64 includes a primary transfer section (a photosensitive drum wrap region) in contact with the photosensitive drum 50 in a wrapped fashion between the wrap-in roll 68 and the wrap-out roll 70.

The primary transfer section of the intermediate transfer belt 64 is wound on the photosensitive drum 50 by a predetermined range, and follows rotation of the photosensitive drum 50. The toner images on the photosensitive drum 50 are primarily transferred onto the intermediate transfer belt 64 by the primary transfer roll 66 while being superimposed on a toner carrying surface (an outer surface) of the intermediate transfer belt 64 in an order of yellow, magenta, cyan, and black. The primarily transferred toner images are conveyed toward the secondary transfer roll 80. The wrap-in roll 68 and the wrap-out roll 70 are distant from the photosensitive drum 50.

The intermediate transfer belt 64 is stretched by the five rolls of the wrap-in roll 68, the wrap-out roll 70, the secondary transfer backup roll 72, the cleaning backup roll 74, and the brush backup roll 76. The primary transfer roll 66 transfers the toner images of the photosensitive drum 50. These rolls are formed to be cylindrical or columnar so as to cyclically stretch and support the intermediate transfer belt 64. The cleaning backup roll 74 and the brush backup roll 76 are arranged to be away from each other. The distance between the rolls 74 and 76 will form one short side of the intermediate transfer belt 64 when the intermediate transfer belt 64 is stretched substantially flat as described above. Due to this, as compared with a configuration in which the distance between the cleaning backup roll 74 and the brush backup roll 76 is large, a size of the intermediate transfer device 62 can be reduced.

On a rear side (a right side surface in FIG. 4) of the intermediate transfer belt 64, a flat portion (the short side) is formed by the wrap-out roll 70 and the secondary transfer backup roll 72. This flat portion serves as a secondary transfer section so as to face the conveyance path 28. In the secondary transfer section, the wrap-out roll 70 is arranged so as to form an angle of about 12 degrees between the intermediate transfer belt 64 and the conveyance path 28. The cleaning backup roll 74 assists a cleaning roll 83, to be described later, in adsorbing and removing the waste toners remaining on the intermediate transfer belt 64 after a secondary transfer. The brush backup roll 76 assists a brush roll 86, to be described later, in scraping off the waste toners remaining on the intermediate transfer belt 64 after the secondary transfer.

A reflection photosensor 78 is provided above the long side of the intermediate transfer belt 64 to be fixed onto a-rear surface (an inside surface) of the opening and closing cover 16. The reflection photosensor 78 reads patches of the toners formed on the intermediate transfer belt 64, detects a position of the toner images in a rotation direction of the intermediate transfer belt 64, and also detects densities of the toner images. The secondary transfer roll 80 is opposite the secondary backup roll 72 of the intermediate transfer device 62 with the conveyance path 28 therebetween. Namely, the position between the secondary transfer roll 80 and the secondary backup roll 72 is the secondary transfer position of the secondary transfer section. The secondary transfer roll 80 secondarily transfers the toner images primarily transferred onto the intermediate transfer bet 64 onto the recording paper P at the secondary transfer position with assistance of the secondary transfer backup roll 72. While the intermediate transfer belt 64 rotates three times, that is, while the toner images of three colors of yellow, magenta, and cyan are primarily transferred onto the intermediate transfer belt 64 in the superimposed manner and conveyed, the secondary transfer roll 80 is kept away from the intermediate transfer belt 64. When the black toner image is transferred, the secondary transfer roll 80 comes in contact with the intermediate transfer belt 64.

The secondary transfer roll 80 and the secondary backup roll 72 are structured to produce a predetermined potential difference therebetween. When a high voltage is applied to the secondary transfer roll 80, the secondary transfer backup roll 72 is connected to the ground. An intermediate transfer belt cleaner 82 is provided on one end of the intermediate transfer belt 64 opposite a photosensitive drum 50-side end. The intermediate transfer belt cleaner 82 includes a charge control sheet 81, the cleaning roll 83, the brush roll 86, a toner recovery case 88, and a rotation spindle 89, and rocks around the rotation spindle 89. The intermediate transfer device 62, the photosensitive drum 50, the charge roll 52, the photosensitive drum cleaner 54, and the intermediate transfer belt cleaner 82 are integrated to structure an image formation unit 96. A fuser 90 is arranged above the secondary transfer position. The fuser 90 includes a heating roll 92 and a pressure roll 94.

In one embodiment, shown in FIG. 1, the printing engine 400 comprises a back up roll 102 having an outer surface and an inner surface, a bias roll 108 adjacent the outer surface of the back up roll 102, a photoreceptor belt 100, a transfer belt 106, and pullies 110. The bias roll 108 is positioned with respect to the back up roll 102 to form a nip 112 between the bias roll 108 and the back up roll 102. A portion of the photoreceptor belt 100 is in the nip 112 between the bias roll 108 and the back up roll 102, and a portion of the transfer belt 106 is in the nip 112 between the bias roll 108 and the photoreceptor belt 100.

Item 300 in FIG. 1 represents the media path, which can be comprised of upper and lower sheet guides to move the media to the nip 112. The media path 300 can also be comprised of a set of upper and lower sheet guides to transport media from the transfer belt 106 to the fusing station.

A transducer 104 (e.g., an ultrasonic piezoelectric device) is positioned to contact the inner surface of the back up roll 102. The transducer 104 can comprise any form of device designed to produce vibrations from a simple electromagnetic device to a piezoelectric device and would be understood by one ordinarily skilled in the art to include any and all devices, whether now known or developed in the future. For example, the transducer 104 can comprise any form of resonator, such as those discussed in U.S. Pat. No. 6,208,824, the complete disclosure of which is incorporated herein by reference.

The transducer 104 can be mounted in any number of ways within the back up roll 102. For example, the transducer 104 can be fixed to a non-rotating axle 116 of the back up roll 102, while the outer shell of the back up roll 102 can freely rotate around the axel and transducer 104. Similarly, the transducer 104 can be mounted as magnets are mounted in developer housings, as shown in, for example, U.S. Pat. Nos. 6,422,984 and 4,823,102, the complete disclosures of which are incorporated herein by reference. Thus, in one embodiment, the transducer 104 is physically connected to the back up roll 102 in a manner such that the transducer 104 transfers vibrations to the back up roll 102 and to the photoreceptor belt 100.

In one embodiment, the transducer 104 can contact and be physically biased against the inner surface of the back up roll 102. The tip of the transducer 104 can be in contact with the inside surface of the back up roll 102. The contact force between the transducer 104 and the inside of the back up roll 102 can be controlled, for example, by a spring-loaded design 114 or by fine tolerance design. The spring 114 biases the transducer 104 against the inner surface of the back up roll 102. Further, such contact force is preserved during ultrasonic vibration by the counteracting force of the bias transfer roll 108 and the transfer belt 106.

The vibrations help toner particles on the photoreceptor belt 100 to vibrate off the photoreceptor belt 100 to the receiving substrate. In FIG. 1, the receiving substrate is the paper passing through the nip 112. In some embodiments, the transducer 104 is connected to the back up roll 102 at a location corresponding to the nip 112.

Figure 2:
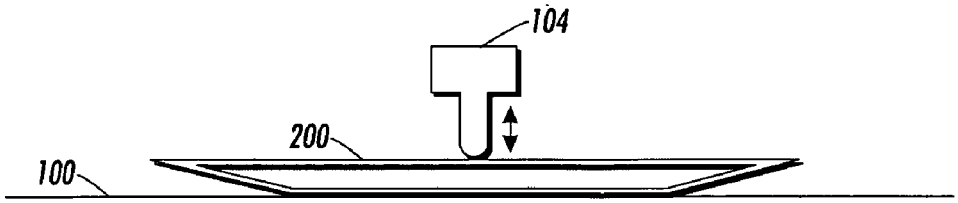
FIG. 2 is a schematic representation of a belt transfer system using a skid plate according to embodiments herein.

In another embodiment shown in FIG. 2, the back up roll 102 comprises a skid plate 200 with an attached transducer 104. The use of skid plates is well-known (for example, see U.S. Patent Application 2004/0114015, the complete disclosure of which is incorporated herein by reference) and a redundant discussion of the same is avoided herein.

Figure 3:
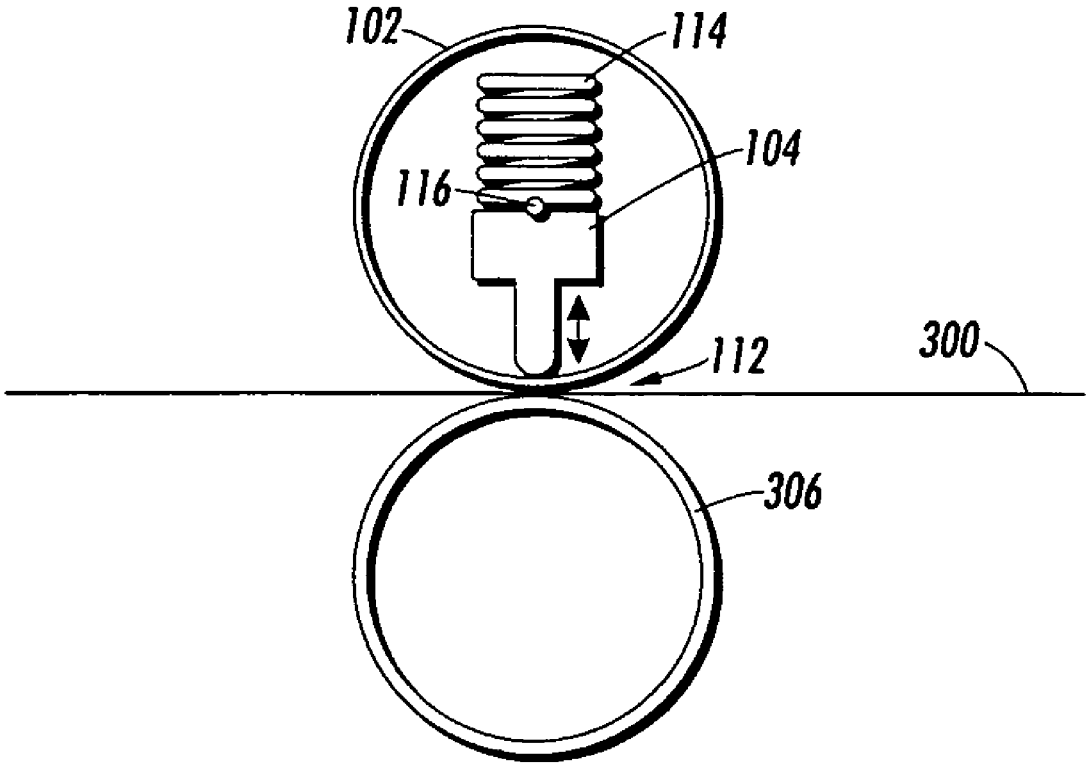
FIG. 3 is a schematic representation of a bias transfer roll system according to embodiments herein.

FIG. 3 illustrates another embodiment that is similar to the system shown in FIG. 1; however, the system in FIG. 3 utilizes a bias transfer roll 306 in place of the bias transfer belt 106, discussed above. The details of bias transfer roll systems are well-known (for example, see U.S. Patent Application 2003/0133729, the complete disclosure of which is incorporated herein by reference) and a redundant discussion of the same is avoided herein. Item 300 in FIG. 3 represents the media path, such as that described in FIG. 1. The media path 300 can be comprised of upper and lower sheet guides to move the media to the nip 112. The back up roll 102 and associated components used in this embodiment are the same as those discussed above. The media path 300 can also be comprised of a set of upper and lower sheet guides to transport media from the nip 112 to the fusing station.

Therefore, as shown above, embodiments herein are useful with multi-stage transfer systems that use intermediate transfer devices (such as intermediate transfer belts (item 62 in FIG. 4)) and with single stage transfer systems where the intermediate transfer device is eliminated, such as FIG. 1, where the photoreceptor belt 100 (that receives the toner directly from the developing units) directly contacts the media that passes through the nip 112, without the aid of intermediate transfer devices. Further, the ultrasonic devices 104 can be included within the back up rolls 102 or within the secondary transfer back-up roll 72 in intermediate transfer devices 62, depending upon specific design limitations.

The word "printer" as used herein encompasses any apparatus, such as a digital copier, bookmaking machine, facsimile machine, multi-function machine, etc. which performs a print outputting function for any purpose. The details of printers, printing engines, etc. are well-known by those ordinarily skilled in the art and are discussed in, for example, U.S. Pat. No. 6,032,004, the complete disclosure of which is fully incorporated herein by reference. The following claims can encompass embodiments that print in monochrome, color or handle color image data. All foregoing embodiments are specifically applicable to electrostatographic and/or xerographic machines and/or processes.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. The claims can encompass embodiments in hardware, software, and/or a combination thereof.

What is claimed is:

1. An apparatus comprising:

a back up roll having an outer surface and an inner surface;

a bias roll adjacent said outer surface of said back up roll, wherein said bias roll is positioned with respect to said back up roll to form a nip between said bias roll and said back up roll;

a photoreceptor belt, wherein a portion of said photoreceptor belt is in said nip between said bias roll and said back up roll;

a transfer belt, wherein a portion of said transfer belt is in said nip between said bias roll and said photoreceptor belt; and a transducer mounted in a non-rotating fixed position within said back up roll, said back up roll rotating around said transducer, and said transducer contacting said inner surface of said back up roll.

2. The apparatus according to claim 1, wherein said transducer is physically connected to said back up roll in a manner such that said transducer transfers vibrations to said back up roll.

3. The apparatus according to claim 1, wherein said transducer comprises an ultrasonic device.

4. The apparatus according to claim 1, wherein said transducer is connected to said back up roll at a location corresponding to said nip.

5. The apparatus according to claim 1, wherein said transducer is physically biased against said inner surface of said back up roll at a location corresponding to said nip.

6. An apparatus comprising:

a back up roll having an outer surface and an inner surface;

a transfer roll adjacent said outer surface of said back up roll, wherein said transfer roll is positioned with respect to said back up roll to form a nip between said transfer roll and said back up roll; and a transducer mounted in a non-rotating fixed position within said back up roll, said back up roll rotating around said transducer, and said transducer contacting said inner surface of said back up roll, wherein said transducer is physically connected to said back up roll in a manner such that said transducer transfers vibrations to said back up roll and to said transfer roll.

7. The apparatus according to claim 6, wherein said vibrations increase the transfer of toner particles on said transfer roll onto the receiver substrate.

8. The apparatus according to claim 6, wherein said transducer comprises an ultrasonic device.

9. The apparatus according to claim 6, wherein said transducer is connected to said back up roll at a location corresponding to said nip.

10. The apparatus according to claim 6, wherein said transducer is physically biased against said inner surface of said back up roll at a location corresponding to said nip.

11. An apparatus comprising:

a back up roll having an outer surface and an inner surface;

a bias roll adjacent said outer surface of said back up roll, wherein said bias roll is positioned with respect to said back up roll to form a nip between said bias roll and said back up roll;

a photoreceptor belt, wherein a portion of said photoreceptor belt is in said nip between said bias roll and said back up roll;

a transfer belt, wherein a portion of said transfer belt is in said nip between said bias roll and said photoreceptor belt; and a transducer mounted in a non-rotating fixed position within said back up roll, said back up roll rotating around said transducer, and said transducer contacting and being physically biased against said inner surface of said back up roll at a location corresponding to said nip.

12. The apparatus according to claim 11, wherein said transducer is physically connected to said back up roll in a manner such that said transducer transfers vibrations to said back up roll.

13. The apparatus according to claim 11, wherein said transducer comprises an ultrasonic device.

14. The apparatus according to claim 11, wherein said transducer is connected to said back up roll at a location corresponding to said nip.

15. The apparatus according to claim 11, wherein said transducer is physically biased against said inner surface of said back up roll.

16. A printing apparatus comprising:

a media path;

a printing engine along said media path, said printing engine comprising:

a back up roll having an outer surface and an inner surface;

a bias roll adjacent said outer surface of said back up roll, wherein said bias roll is positioned with respect to said back up roll to form a nip between said bias roll and said back up roll;

a photoreceptor belt, wherein a portion of said photoreceptor belt is in said nip between said bias roll and said back up roll;

a transfer belt, wherein a portion of said transfer belt is in said nip between said bias roll and said photoreceptor belt; and a transducer mounted in a non-rotating fixed position within said back up roll, said back up roll rotating around said transducer, and said transducer contacting said inner surface of said back up roll.

17. The printing apparatus according to claim 16, wherein said transducer is physically connected to said back up roll in a manner such that said transducer transfers vibrations to said back up roll.

18. The printing apparatus according to claim 16, wherein said transducer comprises an ultrasonic device.

19. The printing apparatus according to claim 16, wherein said transducer is connected to said back up roll at a location corresponding to said nip.

20. The printing apparatus according to claim 16, wherein said transducer is physically biased against said inner surface of said back up roll at a location corresponding to said nip.

* * * * *